United States Patent [19]

Morin

[11] Patent Number: 4,904,351

[45] Date of Patent: Feb. 27, 1990

[54] PROCESS FOR CONTINUOUSLY PLATING FIBER

[75] Inventor: Louis G. Morin, Tarrytown, N.Y.

[73] Assignee: American Cyanamid Company, Stamford, Conn.

[21] Appl. No.: 218,628

[22] Filed: Jul. 13, 1988

Related U.S. Application Data

[63] Continuation of Ser. No. 507,440, Jun. 24, 1983, abandoned, which is a continuation-in-part of Ser. No. 358,637, Mar. 16, 1982, abandoned.

[51] Int. Cl.[4] ..... C25D 7/06

[52] U.S. Cl. ..... 204/28; 204/20; 204/32.1; 204/206

[58] Field of Search ..... 204/28, 30, 206–211, 204/20, 21, 22, 32.1

[56] References Cited

U.S. PATENT DOCUMENTS

| | | | |
|---|---|---|---|
| 2,244,423 | 6/1941 | Hall | 204/209 |
| 3,316,160 | 4/1967 | Uchida et al. | 204/28 |
| 3,346,466 | 10/1967 | Golden et al. | 204/24 |
| 3,436,330 | 4/1969 | Wright et al. | 204/27 |
| 3,550,247 | 12/1970 | Evans et al. | 29/419 |
| 3,556,954 | 1/1971 | Luborsky | 204/28 |
| 3,622,283 | 11/1971 | Sara | 29/183.5 |
| 3,645,856 | 2/1972 | Schulze | 204/28 |
| 3,796,643 | 3/1974 | Swalheim | 204/28 |
| 3,807,996 | 4/1974 | Sara | 75/204 |
| 3,843,493 | 10/1974 | Miller | 204/30 |
| 3,894,677 | 7/1975 | La Lacona | 228/190 |
| 3,896,010 | 7/1975 | Vetter | 204/28 |
| 3,953,647 | 4/1976 | Brennan et al. | 428/378 |
| 4,048,042 | 9/1977 | Quinn | 204/206 |
| 4,050,997 | 9/1977 | Heissler et al. | 204/28 |
| 4,132,828 | 1/1979 | Nakamura et al. | 428/366 |
| 4,357,985 | 11/1982 | Sexton | 164/61 |
| 4,367,127 | 1/1983 | Messing et al. | 204/105 R |
| 4,395,320 | 7/1983 | Kasashima et al. | 204/206 |

FOREIGN PATENT DOCUMENTS

| | | | |
|---|---|---|---|
| 3108380 | 2/1982 | Fed. Rep. of Germany . | |
| 1535660 | 8/1968 | France . | |
| 52-43770 | of 1974 | Japan . | |
| 55-1358 | 1/1980 | Japan | 204/28 |
| 57-79200 | 5/1982 | Japan . | |
| 496331 | of 1976 | U.S.S.R. . | |
| 1208959 | 10/1970 | United Kingdom . | |
| 1215002 | 12/1970 | United Kingdom . | |
| 1272777 | 5/1972 | United Kingdom . | |
| 1309252 | 3/1973 | United Kingdom . | |

OTHER PUBLICATIONS

Paper No. 14, Plastics Institute, Feb. 2–4 (1971), London, B. W. Howlett et al.

Izv. Akad. Nauk. Mold SSR. Ser. Fig.-Tech. Mat. Nauk (1975) (2), 76–80, Ponomar et al. (Translation into English).

Voluknist i Dispersnorprochnen. Kompozitsion. Materialy 1976, 38–40, A. N. Yagubest (Translation into English).

*Primary Examiner*—John F. Niebling
*Assistant Examiner*—William T. Leader
*Attorney, Agent, or Firm*—Steven H. Flynn

[57] ABSTRACT

A graphite fiber is electroplated by passing the fiber continuously through an electrolyte solution in a tank. Current is delivered to the fiber at a contact immediately prior to the surface of the electrolyte in the tank. The voltage is maintained above 16 volts. The fiber is kept cool enough outside the bath to prevent degradation by recycling the electrolyte to bathe the fiber from the point of contact to the point of immersion into the electrolyte.

21 Claims, 14 Drawing Sheets

PROCESS FOR CONTINUOUSLY PLATING FIBER

CROSS-REFERENCE TO RELATED APPLICATIONS

This application is a continuation of Ser. No. 507,440, filed June 24, 1983, which is a continuation-in-part of Ser. No. 358,637, filed Mar. 16, 1982, now abandoned for YARNS AND TOWS COMPRISING HIGH STRENGTH METAL-COATED FIBERS, PROCESS FOR THEIR PRODUCTION, AND ARTICLES MADE THEREFROM by Louis George Morin. This application is also related to applications for IMPROVED TENSIONING MECHANISM AND CATHODE ROLLERS FOR FIBER PLATING by Louis George Morin and Robert E. Hoebel (110-024) and CONTACT ROLLER MOUNTING ASSEMBLY AND TENSIONING MECHANISM FOR ELECTROPLATING FIBER by Robert E. Hoebel (110-029), both filed June 24, 1983.

BACKGROUND OF THE INVENTION

1. Field of the Invention

This invention relates to metal coated filaments and to a process and an apparatus for their continuous production.

2. Description of the Prior Art

Filaments comprising non-metals and semi-metals, such as carbon, boron, silicon carbide, polyester, nylon, aramid, cotton, rayon, and the like, in the form of monofilaments, yarns, tows, mats, cloths and chopped strands are known to be useful in reinforcing metals and organic polymeric materials. Articles comprising metals or plastics reinforced with such fibers find wide-spread use in replacing heavier components made up of lower strength conventional materials such as aluminum, steel, titanium, vinyl polymers, nylons, polyester, etc., in aircraft, automobiles, office equipment, sporting goods, and in many other fields.

A common problem in the use of such filaments, and also glass, asbestos and others, is a seeming lack of ability to translate the properties of the high strength filaments to the material to which ultimate and intimate contact is to be made. In essence, even though a high strength filament is employed, the filaments are merely mechanically entrapped, and the resulting composite pulls apart or breaks at disappointingly low applied forces The problems have been overcome in part by depositing a layer or layers of metals on the individual filaments prior to incorporating them into the bonding material, e.g., metal or plastic Metal deposition has been accomplished by vacuum deposition, e.g., the nickel on fibers as described in U.S. Pat. No. 4,132,828; and by electroless deposition from chemical baths, e.g., nickel on graphite filaments as described in U.S. Pat. No. 3,894,677; and by electrodeposition, e.g., the nickel electroplating on carbon fibers as described in Sara, U.S. Pat. No. 3,622,283 and in Sara, U.S. Pat. No. 3,807.996. When the metal coated filaments of such procedures are twisted or sharply bent, a very substantial quantity of the metal flakes off or falls off as a powder. When such metal coated filaments are used to reinforce either metals or polymers, the ability to resist compressive stress and tensile stress is much less than what would be expected from the rule of mixtures, and this is strongly suggestive that failure to efficiently reinforce is due to poor bonding between the filament and the metal coating.

It has now been discovered that if electroplating is selected and if an amount of voltage is selected and used in excess of that which is required to merely dissociate (reduce) the electrodepositable metal ion on the filament surface, a superior bond between filament and metal layer is produced. The strength is such that when the metal coated filament is sharply bent, the coating may fracture, but it will not peel away. Moreover, continuous lengths of such metal coated filaments can be knotted and twisted without substantial loss of the metal to flakes or powder. High voltage is believed important to provide or facilitate uniform nucleation of the electrodepositable metal on the filament, and to overcome any screening or inhibiting effect of materials absorbed on the filament surface.

Although a quantity of electricity is required to electrodeposit metal on the filament surface, an increase in voltage to increase the amperes may cause the filaments to burn, which would interrupt a continuous process. The aforesaid Sara U.S. Pat. No. 3,807,966, uses a continuous process to nickel plate graphite yarn, but employs a plating current of only 2.5 amperes, and long residence times, e.g. 14 minutes, and therefore low, and conventional, voltages. In another continuous process, described in U.K. Pat. No. 1,272,777, the individual fibers in a bundle of fibers are electroplated without burning them up by passing the bundle through a jet of electrolyte carrying the plating material, the bundle being maintained at a negative potential relative to the electrolyte, in the case of silver on graphite, the potential between the anode and the fibers being a conventional 3 volts.

The present invention provides an efficient apparatus to facilitate increasing the potential between anode and the continuous filament cathode, since it is a key aspect of the present process to increase the voltage to obtain superior metal coated fibers. In addition, since it permits extra electrical energy to be introduced into the system without burning up the filaments, residence time is shortened, and production rates are vastly increased over those provided by the prior art. As will be clear from the detailed description which follows, novel means are used to provide high voltage plating, strategic cooling, efficient electrolyte-filament contact and high speed filament transport in various combinations, all of which result in enhancing the production rate and quality of metal coated filaments. Such filaments find substantial utility, for example, when incorporated into thermoplastic and thermoset molding compounds for aircraft lightning protection, EMI/RFI shielding and other applications requiring electrical/thermal conductivity. They are also useful in high surface electrodes for electrolytic cells. Composites in which such filaments are aligned in a substantially parallel manner dispersed in a matrix of metal, e.g., nickel coated graphite in a lead or zinc matrix are characterized by light weight and superior resistance to compressive and tensile stress. The apparatus of this invention can also be employed to enhance the production rate and product quality when electroplating normally non-conductive continuous filaments, e.g., polyaramids or cotton, etc., if first an adherent electrically conductive inner layer is deposited, e.g., by chemical means on the non-conductive filament

SUMMARY OF THE INVENTION

It is a basic object of the present invention to provide fibers formed of a conductive semimetallic core with metallic coatings.

It is another object of the present invention to provide a process in which the electroplating of the fibers is effected under high voltage electroplating conditions.

Further, it is an object of the present invention to provide a process and apparatus which will efficiently and rapidly coat fibers with metallic coatings and facilitate the rinsing and collecting of the finished product.

A still further object of the present invention is to provide fibers that are evenly plated around their diameter to the extent that any deviation in thickness of the plating is less than ten percent.

It is also an object of the present invention to plate all the fibers in a tow with the same width of material, within ten percent, regardless of whether the tow width is small or large, i.e., 3K to 12×12K.

It has been found that these and other objects are obtained by the use of high voltages in the apparatus and process of the subject invention.

In accordance with the present invention, apparatus has been provided in which a plurality of fibers can be simultaneously plated efficiently with a metal surface and thereafter cleaned and reeled for use in a variety of end products.

The apparatus is provided generally with a pay-out assembly adapted to deliver a multiplicity of fibers to an electrolytic plating bath. The pre-treatment process includes tri-sodium phosphate cleaning, rinsing and acid wash. Thereafter, metal-plating is performed in a continuous process by the passage of the clean fibers through an electrolyte in which the plating of the fibers is carried out at high voltage conditions. Means are provided to cool the fibers during the passage from the contact roll associated with the electrolytic tank and the electrolyte bath. Preferred means, in essence, are constituted by a recycle of electrolyte at strategic positions over the contact rollers and the fiber. The process also contemplates a series of discrete electrolytic tanks associated with separate rectifiers to facilitate variable current plating. The current is varied as a function of the resistance developed by the plating on the fibers.

After the plating has been completed, the plated fibers are rinsed by water and steam treated and thereafter dried.

As a result of the high voltage electroplating process, the continuous line is provided with means for synchronization of each of the process steps with the other. The high voltage environment also includes a specially designed commutation system for the contact rollers in which fingers of unequal length are provided and by the specially designed anode arrangement comprising an anode basket, a portion of which is coated with insulation for protection from the electrolyte bath.

The rinse tanks and electrolytic tanks are specially designed for maintenance of electrolyte level and minimal accumulation of waste rinse fluid.

The special rollers developed to use in the pay-out further facilitate the effectiveness of the process.

DESCRIPTION OF THE DRAWINGS

The invention will be more readily understood when viewed in association with the following drawings wherein.

DESCRIPTION OF THE PREFERRED EMBODIMENT

The process and apparatus of the present invention are directed to providing an efficient and complete means for metal-plating non-metallic and semi-metallic fibers.

The process of the invention relies on the use of very high voltage and current to effect satisfactory plating. As a result of the high voltage and current, an apparatus has been developed that can produce high volumes of plated material under high voltage conditions.

The process of the present invention and the apparatus particularly suitable for practicing the process of the invention are described in the preferred embodiment in which the specified fiber to be plated is a carbon or graphite fiber and the plating metal is nickel. However, the process and apparatus of the present invention are suitable for virtually the entire spectrum of metal-plating of non-metallic and semi-metallic fibers.

Figure 1:
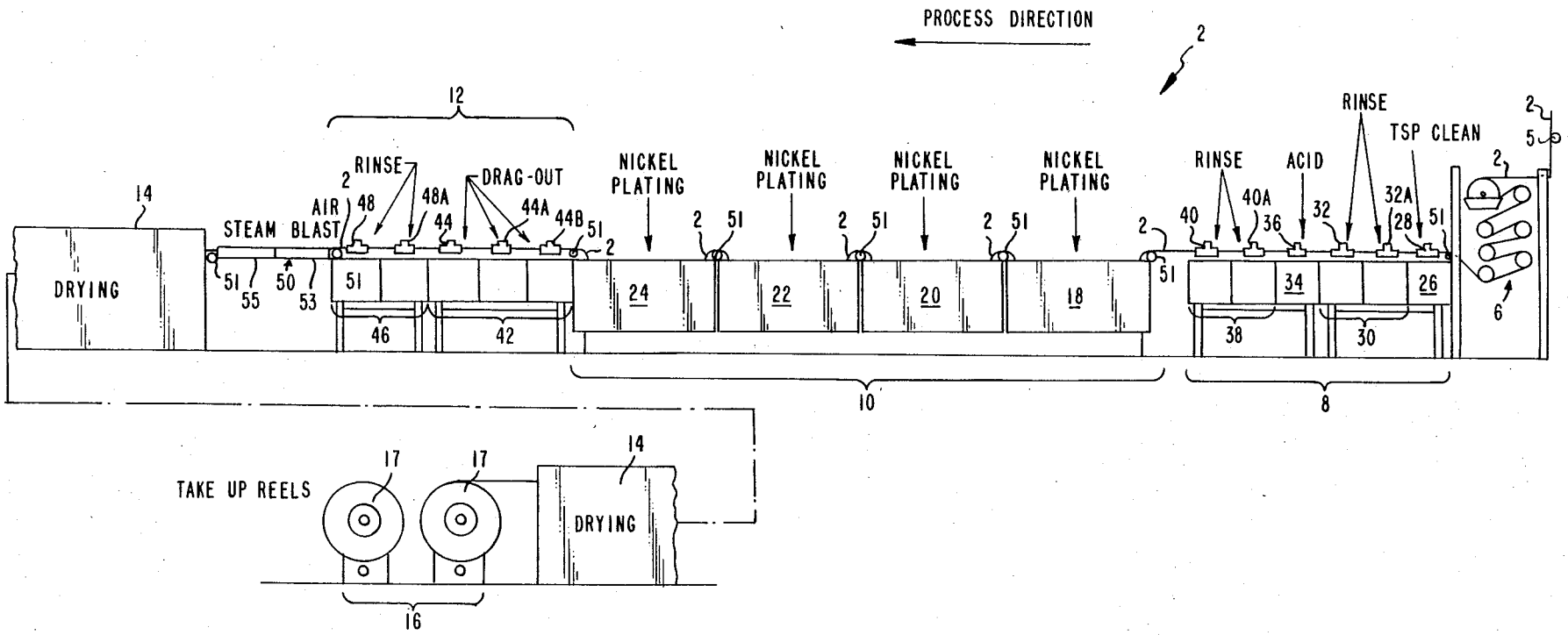
FIG. 1 is a schematic view of the overall process of the subject continuous electrolytic plating process except for the pay-out assembly.

The overall process and schematic of the apparatus except for the pay-out assembly are generally shown in FIG. 1. The operative process includes in essence, a pay-out assembly for dispensing multiple fibers in parallel, tensioning rollers 6, a pre-treatment section 8, a plating facility 10, a rinsing station 12, a drying section 14 and take-up reels 16.

Figure 7:
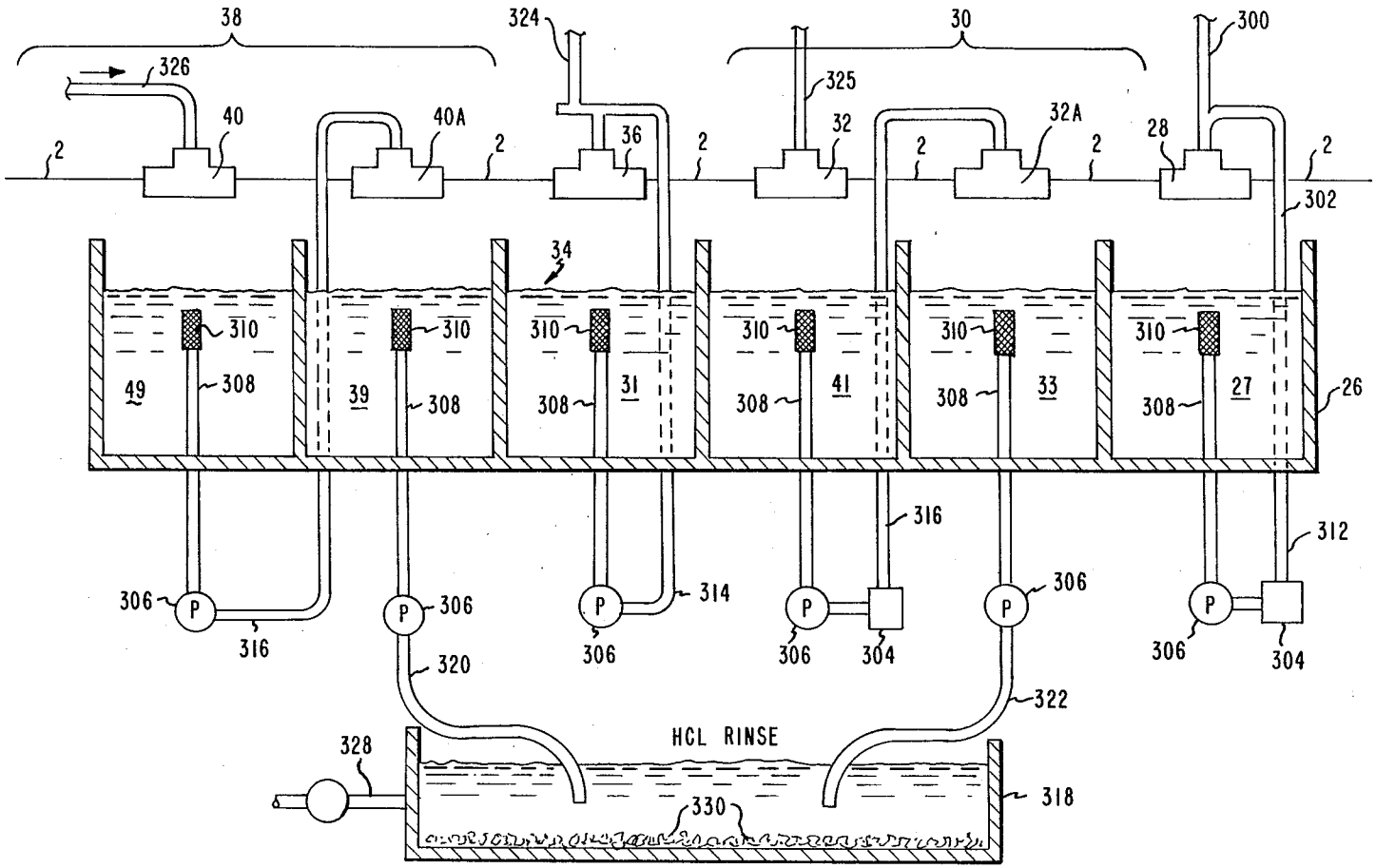
FIG. 7 is a sectional elevational view of the pre-treatment tank and associated apparatus.

More particularly, the pre-treatment section 8 shown generally in FIG. 1 includes a tri-sodium phosphate cleaning section 26 and an associated washing-tee 28, rinse section 30 and associated washing-tees 32 and 32A, a hydrochloric acid section 34 and associated tee 36, and rinse section 38 with associated washing-tees 40 and 40A all of which are described in FIG. 7. The plating facility 10 is comprised of a plurality of series arranged electrolyte tanks shown illustratively in FIG. 1 as tanks 18, 20, 22 and 24, each of which is charged with current by a separate rectifier, better seen in FIGS. 8 and 22. The rinsing section 12, shown generally in FIG. 1 is comprised of tank and tee assemblies similar to the pre-treatment apparatus. An arrangement of cascading tanks 42 and tees 44, 44A and 44B cycle rinse solution of water and electrolyte over the fibers 2. Thereafter, clean water is passed over the fibers 2 in the rinse section 46 provided with tanks and washing-tees 48 and 48A seen more specifically in FIG. 26. The rinsed fiber 2 is passed through section 50 wherein it is air blasted in subsection 53 and then steam-treated in section 55 to produce an oxide surface on the metal plate. The process is completed by passage of the metal plated fiber 2 through the drying unit 14 and reeling of the finished fibers on take-up reels 17 in the reeling section 16.

As seen generally in FIG. 1, the apparatus is provided with means to convey the fibers 2 through the system rapidly without abrading the fibers 2. The combination of strategically located guide rollers 51, tension rollers 6, force imposing rollers in the drying section 14 and a synchronous drive assembly shown in FIG. 27 rapidly conveys the fibers 2 through the apparatus without abrasion of the fibers 2.

Figure 3:
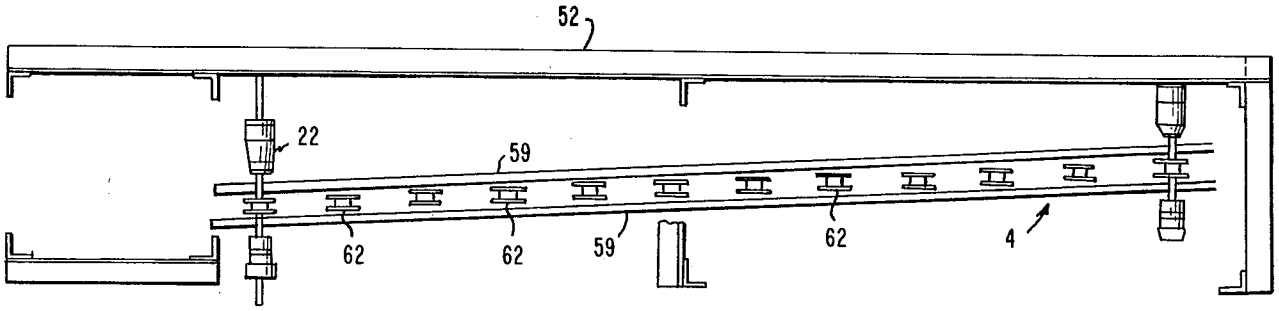
FIG. 3 is a plan view of the pay-out assembly of FIG. 2.
Figure 2:
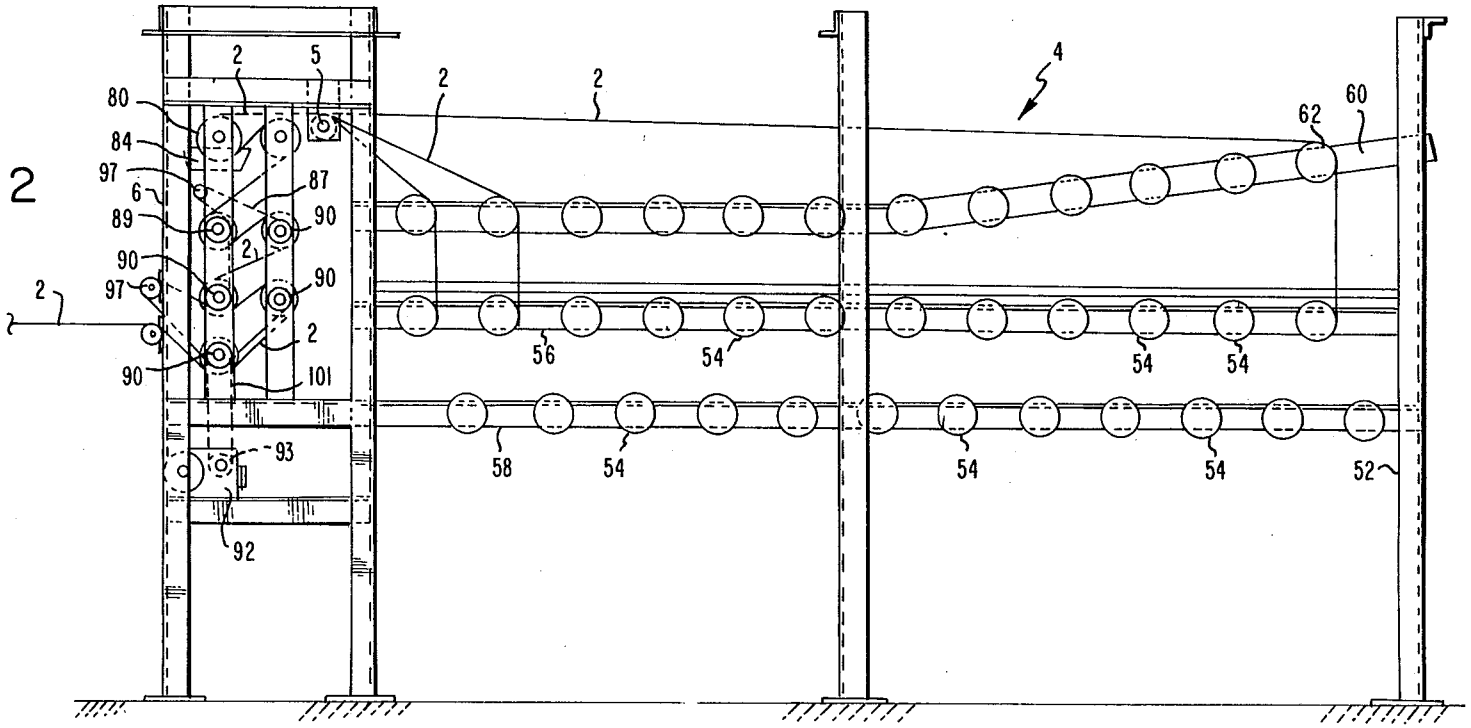
FIG. 2 is an elevational view of the pay-out section arranged specifically to simultaneously deliver a multiplicity of fibers to the electrolytic plating operation.

The operation begins with the pay-out assembly 4 shown in FIGS. 2 and 3. Functionally, the fibers 2 from the pay-out assembly 4 are delivered over a guide roller 5 through the tensioning rollers 6 to the pre-treatment section 8.

As best seen in FIGS. 2 and 3, the pay-out assembly 4 is comprised of a frame 52 on which the pay-out rollers 54 are mounted. The structure of the rollers 54 is better seen in FIGS. 4 and 5 and will be described more particularly in association with FIGS. 4 and 5. The pay-out rollers 54 are mounted on the frame 52 on a rail 56 and a rail 58. The rollers 54 on rail 56 are arranged to pay-out the fibers 2 to the electroplating system while the rail 58 is an auxiliary rail adapted to mount the spare rollers 54 available to provide alternate duty. A rail 60 mounts guide rollers 62 over which the fibers 2 from the pay-out rollers 54 travel to reach the tensioning rollers 6. As best seen in FIG. 2, the fibers 2 extend from the respective rollers 54 over individual guide roller 62 associated with a particular roller 54 to the common guide roller 5 and into the tensioning roller assembly 6. Guide bars 59 are provided to guide fibers 2 from the pay-out rollers 54 to the associated guide rollers 62.

As seen in FIG. 3, the guide rollers 62 are aligned adjacent to each other to avoid interference between the fibers 2 as a plurality of fibers 2 are simultaneously delivered to the system to be treated and plated.

Figure 4:
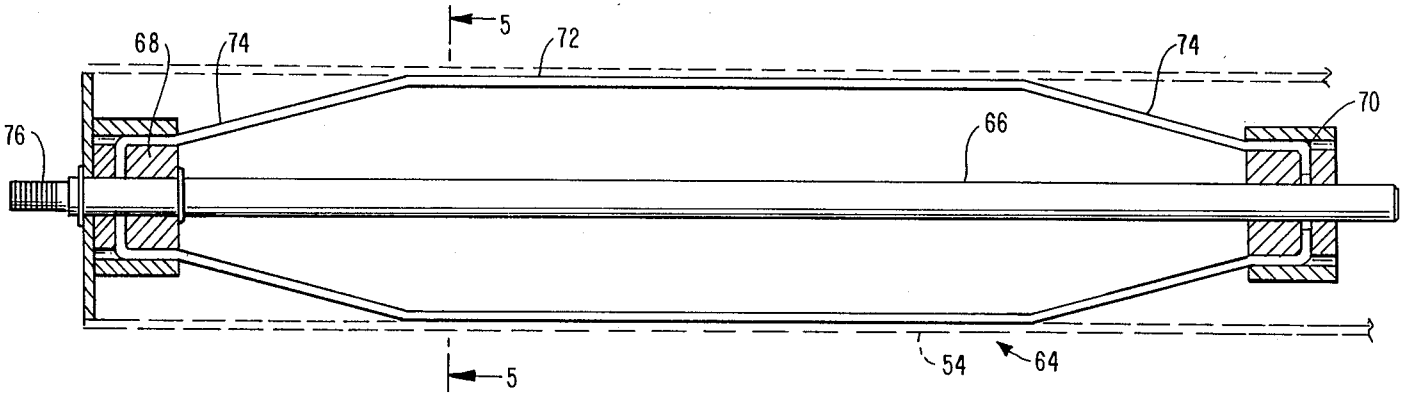
FIG. 4 is a sectional elevational view of the pay-out roller assembly.
Figure 5:
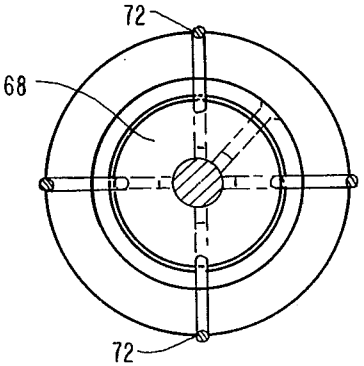
FIG. 5 is a sectional view through line 5—5 of FIG. 4.

The structure of the pay-out rollers 54 is best seen in FIGS. 4 and 5. The pay-out rollers 54 are comprised essentially of a centrally disposed rod 66 having end bearings 68 and 70, and are arranged to accommodate a compressive frame 64 formed of wires 72. Practice has taught that four resilient wires 72 arranged ninety degrees from each other will form a frame 64 suitable for mounting most commercial spools of fiber. Bearing 68 is arranged to bear against either the rail 56 or the rail 58 of the pay-out assembly 4.

The rod 66 is provided with a threaded end 76 that passes through an opening in the rails 56 or 58. A conventional nut (not shown) is used to attach the pay-out roller 54 which is thus cantilever mounted with the free end bearing 70 having a sliding fit on the bar 66. Thus, if the pay-out roller frame wires 72 are compressed, the bearing 70 can move transversely on the rod 66. Further, the frame wires 72 of the roller mount 64 are provided with tapered ends 74. As a result of the taper in the frame wires 72 and the transversely movable bearing 70, the compressive frame 64 can adjust to accept fiber spools of various diameter.

Figure 6:
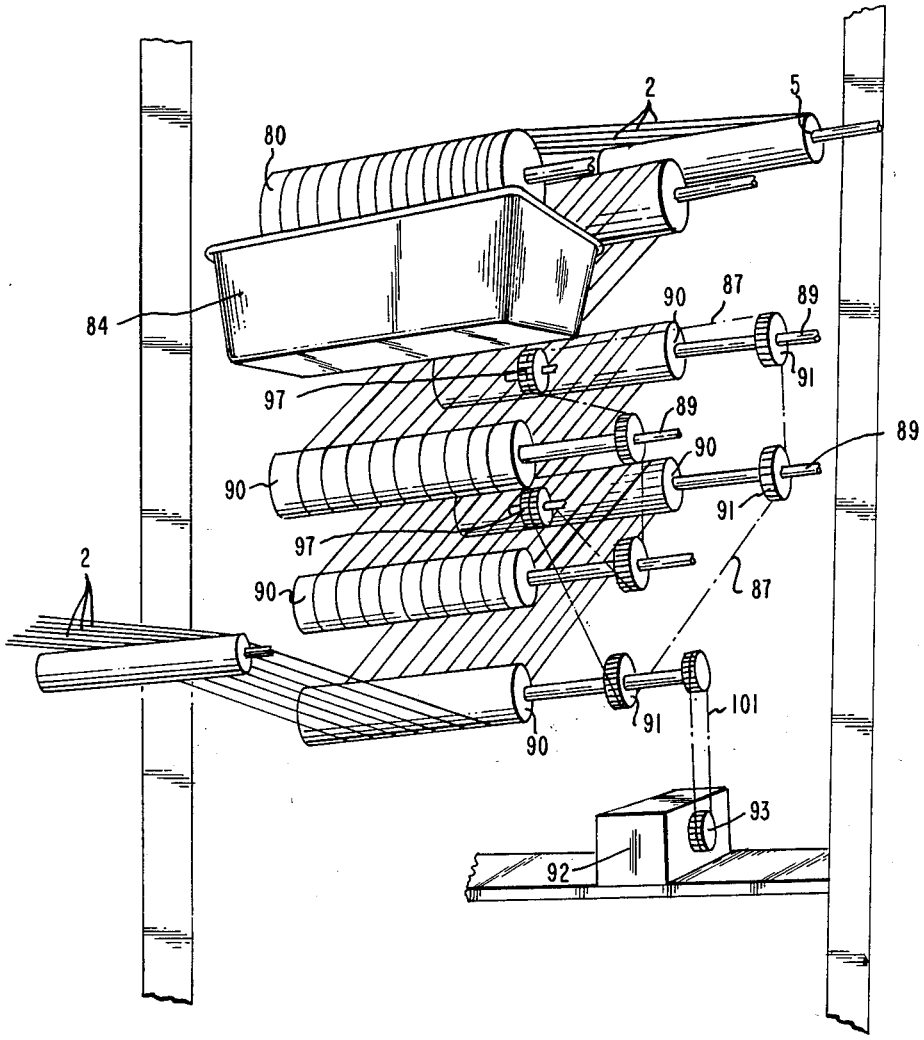
FIG. 6 is an isometric view of the wetting and tensioning rollers between the pay-out and electrolytic bath.

The pay-out assembly 4 delivers the fibers 2 over a guide roller 5 to a wetting roller 80 and then to the tensioning rollers 6. A wetting tub 84 is provided with water which wets the fibers 2 and enables suitable and more efficient cleaning and rinsing of the fibers 2 during pre-treatment. The tensioning rollers 6 seen in FIG. 1 are shown in more detail in FIG. 6.

The tensioning rollers 6 comprise an assembly of five rollers 90, all of which are driven through a single continuous chain 87 by a common source such as a variable speed motor 92. Each roller 90 is mounted on a shaft 89 which also mounts a fixed gear 91 around which the chain 87 is arranged. Idler rollers 97 are also arranged to engage the chain 87. A gear 93 extending from the shaft 95 of the variable speed motor 92 drives the continuous chain 87 through a chain 101 and a gear 103 fixed to the shaft 89 of a roller 90. It is necessary that tension be provided to the fibers 2 at a location in the line upstream of the first plating contact roller. The plating contact roller and the fibers 2 must be in tight contact to facilitate the operation at the high voltage and high current levels necessary for the process. With tight contact, low resistance is provided between the fibers 2 and the contact rollers, thus the high current passing through the system circuit will not overload the fibers 2 causing destruction of the fibers. As a result, the tension roller assembly 6 is located upstream of the electroplating tanks 18, 20, 22, 24 (FIG. 1) to provide that tension. On the other hand, the fibers should be subjected to as little drag as possible. Inherent in the fibers 2 is the tendency to separate at the surface and accumulate fuzz. The variable drive motor 92 is coupled to all five of the rollers 90 to provide variable speed for the rollers at some speed equal to or less than the speed of the fibers 2. At carefully controlled speeds the necessary tension is provided without causing fuzz to accumulate on the fibers. The apparatus and process are designed to afford a tension roller assembly 6 in which the tension rollers 90 travel at a slower speed than the fibers 2. The tension on the fibers 2 is maintained by varying the speed of the tension roller 90 in response to visual determination of the tension.

In the pre-treatment section 8, best seen in FIGS. 1 and 7, the apparatus is comprised of a tri-sodium phosphate cleaning section 26 followed by a rinse section 30, and an acid cleaning section 34 followed by another rinse section 38. Each of the pre-treatment sections 26, 30, 34 and 38 are provided respectively with washing-tees 28, 32-32A, 36 and 40-40A shown in detail in FIGS. 22-24. Each pre-treatment section 26, 30, 34 and 38 is also provided with a tank into which the discharge from the washing-tees 28, 32A, 32, 63, 40A and 40 flow. The tri-sodium phosphate cleaning section 26 and the acid cleaning station 34 have single tanks 27 and 31 respectively. The rinse sections 30 and 38 have two tanks each, 33, 41 and 39, 49 respectively. In operation the fibers 2 pass through the tees 28, 32A, 32, 36, 40A and 40 in one direction while fluid passes through in the opposite direction.

A tri-sodium phosphate cleaning solution of generally any suitable concentration can be used in the cleaning section 26. However, practice has taught that eight ounces of tri-sodium phosphate per gallon of water at 180° F. will provide the cleaning necessary for carbon fibers. Water is used in the rinse section 30 to remove residual tri-sodium phosphate from the fibers 2 exiting from the tri-sodium phosphate section 26.

The fibers then pass through the tee 36 in the acid cleaning section 34 as the acid solution passes counter-currently with the fibers 2. The acid suitable for pre-treatment in association with the tri-sodium phosphate cleaning is a 10% hydrochloric acid solution. Thereafter, the fibers 2 are rinsed with water in the rinse section 38 wherein water again enters through the top of the tees 40 and 40A and exists through the upstream section of the tee opening thereby passing counter-currently with the fibers 2.

As seen in FIG. 7, the pre-treatment section 8 is interconnected to facilitate the pre-treatment of the fibers 2 and to avoid or minimize the accumulation of contaminated pre-treatment solution. Each pre-treatment tank is provided with a stand pipe 308 that has a basket filter 310 arranged over the opening. Discharge from the tank is pumped from each tank through the stand pipe 308 by a pump 306. A line 316 from the stand pipe 308 in the rinse tank 49 communicates with the fluid inlet of the tee 40A associated with the rinse tank 39. A line 326 is connected to the inlet of the tee 40 associated with the tank 49 and a discharge line 320 is provided for the discharge of fluid from the tank 39.

A recirculating line 314 extends from the stand pipe 308 in the tank 31 to the fluid inlet of tee 36 to recirculate the hydrochloric acid wash. An inlet line 324 is provided to deliver initial and make-up hydrochloric acid wash to the fluid side of the tee 36.

The rinse tanks 41 and 33 are provided with a line 325 to the fluid inlet of the tee 32 associated with the tank 41 and a line 316 from the stand pipe 308 in tank 41 to the inlet of the tee 32A associated with the tank 33. A discharge line 322 is provided for discharge from the tank 33.

The tri-sodium phosphate tank 27 is provided with both a recirculating line 312 from the stand pipe 308 to the inlet of the tee 28 and a line 300 to deliver initial and make-up tri-sodium phosphate to the fluid inlet of the tee 28.

A neutralizing tank 318 charged with a neutralizing agent 330, such as Dolomite, is provided in the system to receive hydrochloric acid discharge from rinse tank 39 and tri-sodium phosphate discharge from rinse tank 33.

In operation the fibers 2 pass through the tees 28, 32A, 32, 36, 40A and 40 as fluid passes from the fluid inlets of the tees out the upstream fiber entry openings of the tees. The tri-sodium phosphate wash is recycled through stand pipe 308 and recycle line 312. Residue on the fibers 2 after passage from the tee 28 is rinsed from the fibers 2 by clear water that passes through the tee 32 associated with the rinse tank 41 and discharge from the rinse tank 41 that passes through the tee 32A associated with the rinse tank 33. The fluid in the rinse tank 33 which becomes contaminated with tri-sodium phosphate is discharged to the neutralizing tank 318.

After the fibers 2 leave the rinse section 30, hydrochloric acid wash is passed over the fibers 2 in tee 36. The discharge from the tee 36 is recycled to the fluid inlet of the tee 36 through stand pipe 308 in the tank 31 and recirculation line 314. The fibers 2 leaving the tee 36 are rinsed in rinse section 38. Clear water enters the rinse section 38 through the tee 40 associated with the rinse tank 49 and flows to the rinse tank 49. The fluid from rinse tank 49 is pumped through line 316 to the fluid inlet of the tee 40A associated with the rinse tank 39 and passed over the fibers 2 into the rinse tank 39. The fluid in the rinse tank 39 becomes contaminated with hydrochloric acid and is discharged through line 320 to the neutralizing tank.

The nature of the tri-sodium phosphate and the hydrochloric acid in combination with a calcium based material such as Dolomite neutralize the waste and minimize the additional treatment required for the waste before discharge through line 328 to waste.

The pre-treated fibers 2 are next electroplated. As seen in FIG. 1, a plurality of electroplating tanks 18, 20, 22 and 24 are provided in series. Under the high voltage-high current conditions of the process, the series arrangement of electroplating tank 18, 20, 22 and 24 afford means for providing discrete voltage and current to the fibers 2 as a function of the accumulation of metal-plating on the fibers 2. Thus, depending on the amount of metal-plating on the fibers 2, the plating voltage and current can be set to levels most suitable for the particular resistance developed by the fiber and metal.

Figure 8:
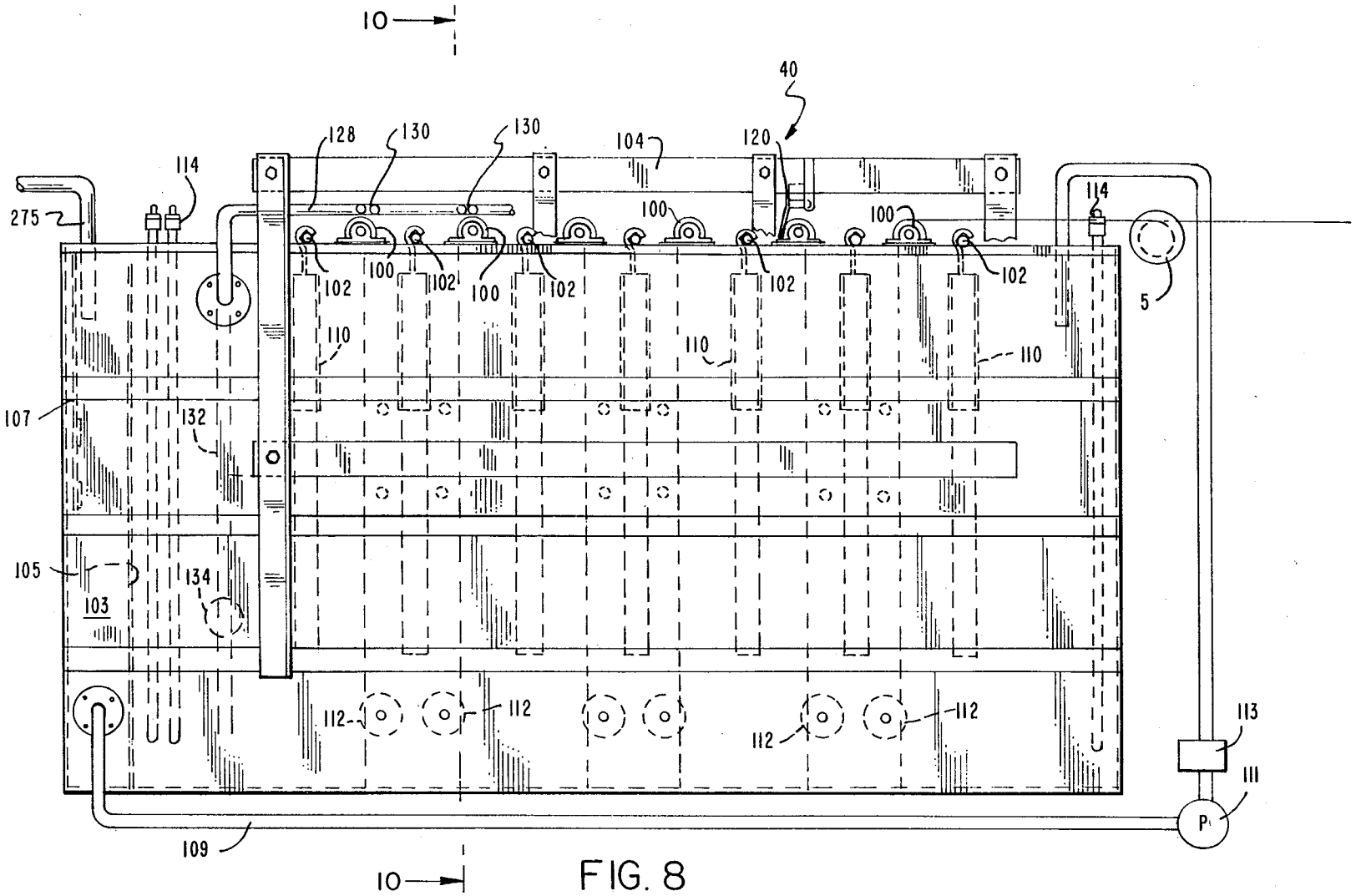
FIG. 8 is an elevational view of one electrolytic tank.
Figure 9:
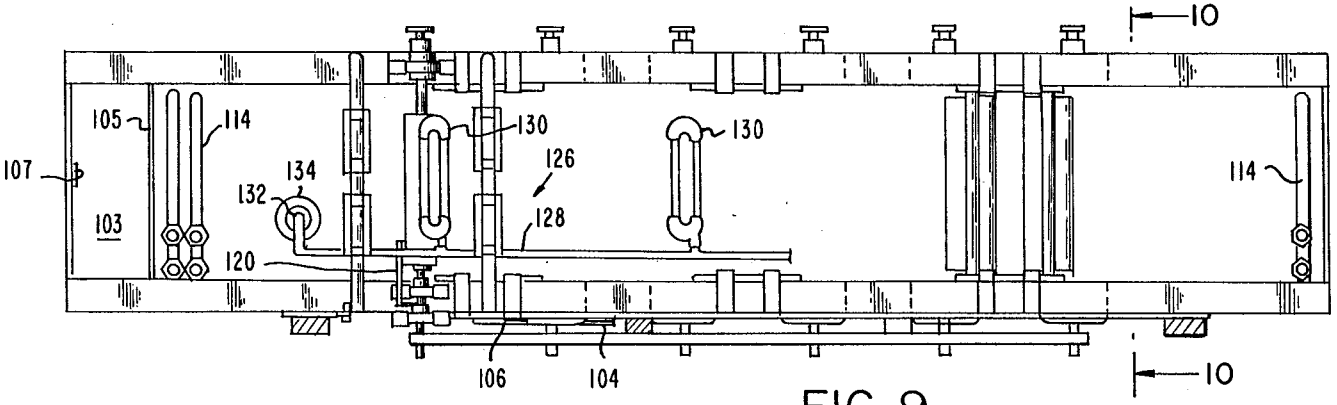
FIG. 9 is a plan view of the tank of FIG. 8.
Figure 10:
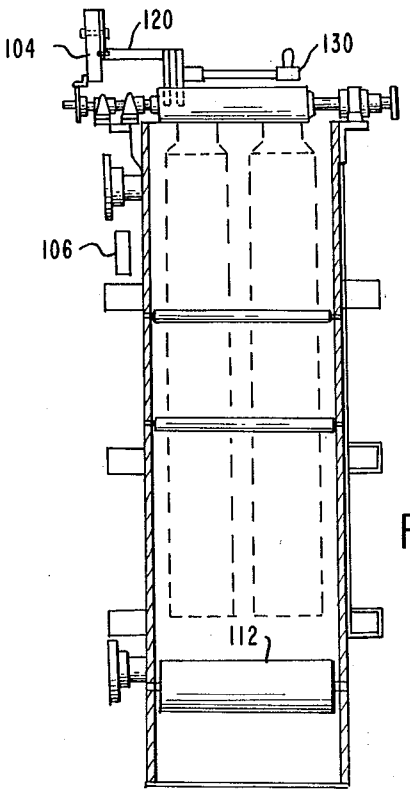
FIG. 10 is a sectional elevational view through line 10—10 of FIG. 8.
Figure 12:
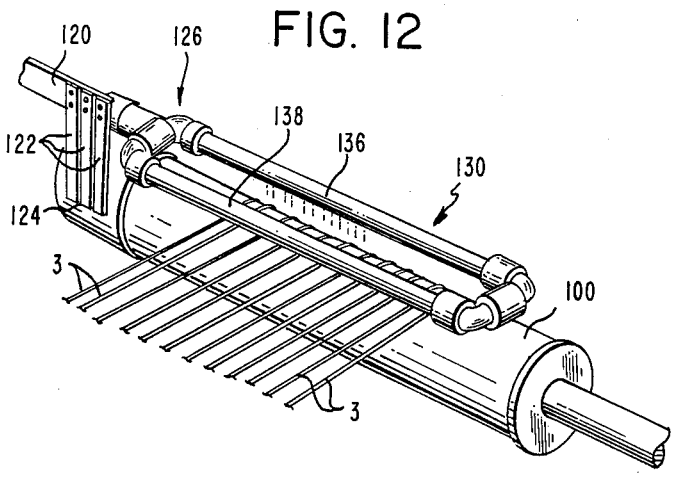
FIG. 12 is an isometric view of one contact roller in association with the means for providing coolant to the fibers and a current carrying medium from the contact roller to the bath.
Figure 22:
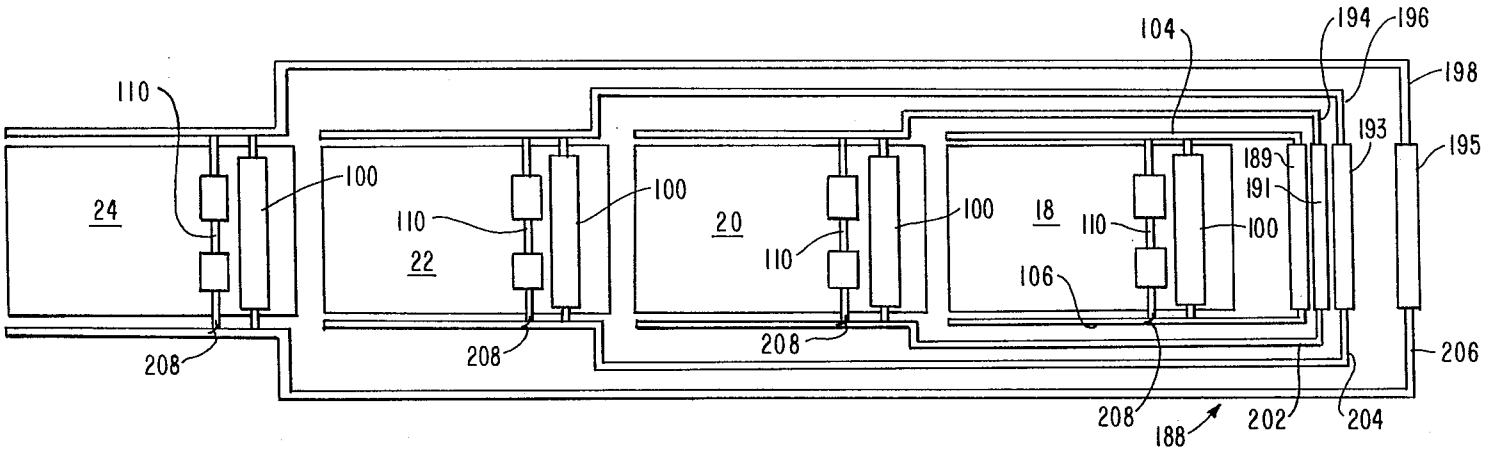
FIG. 22 is a view of the electrical system of the present invention.

The electrolytic plating tank 18 is shown in FIGS. 8, 9 and 10 and is identical in structure to the plating tanks 20, 22 and 24 shown in FIG. 1. The tank 18 is arranged to hold a bath of electrolyte. The tank 18 has mounted therewith contact rollers 100 and anode support bars 102 which are arranged in the circuit. The contact rollers 100 receive current from the bus bar 104 and the anode support bars 102 are connected directly to a bus bar 106. Each of the plating tanks 18, 20, 22 and 24 are provided with similar but separate independent circuitry as seen in FIG. 22. The anode support bars 102 have mounted thereon anode baskets 110 arranged to hold and transfer current to nickel or other metal-plating chips.

Each tank 18, 20, 22 and 24 is also provided with heat exchangers 114 to heat the electrolyte bath to reach the desirable initial temperature at start-up and to cool the electrolyte during the high intensity current operation.

The tank 18 is provided with a well 103 defined by a solid wall 105 in which a level control 107 is mounted and with a recirculation line 109. The recirculation line 109 includes a pump 111 and a filter 113 and functions to continuously recirculate electrolyte from the well 103 to the tank 18. Under normal operating conditions recirculated electrolyte will enter the tank 18 and cause the electrolyte in the tank to rise to a level above the wall 105 and flow into the well 103. When electrolyte has evaporated from the tank the level in the well will drop and call for make-up from the downstream rinse section 12 shown in FIG. 26.

The tank 18 is also provided with a line 132 and pump 134 through which electrolyte is pumped to a manifold 128 that delivers the electrolyte to the spray nozzle 130 above the contact rollers 100.

Figure 13:
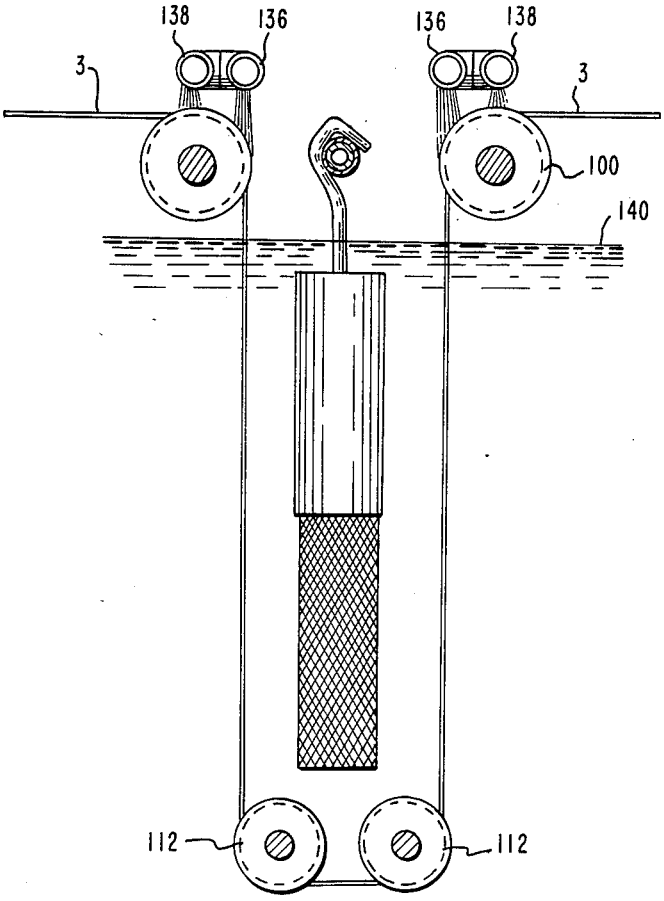
FIG. 13 is an elevational view of a section of the electrolytic tank depicting an anode basket.
Figure 14:
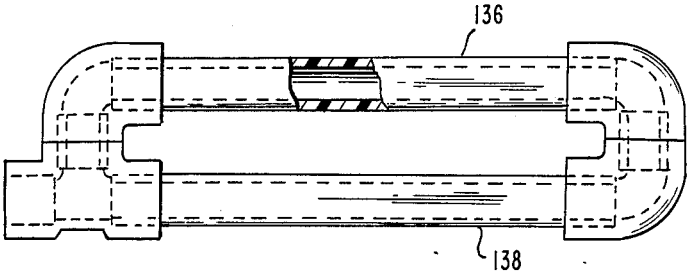
FIG. 14 is a plan view of the means for delivering electrolyte to the fibers extending from the contact roller to the electrolytic bath.

As shown in more detail in FIG. 13, the fibers 2 pass over the contact rollers 100 and around idler rollers 112 located in proximity to the bottom of the tank. The idler rollers 112 are provided in pairs around which the fibers 2 pass to move into contact with the succeeding contact roller 100.

Figure 11:
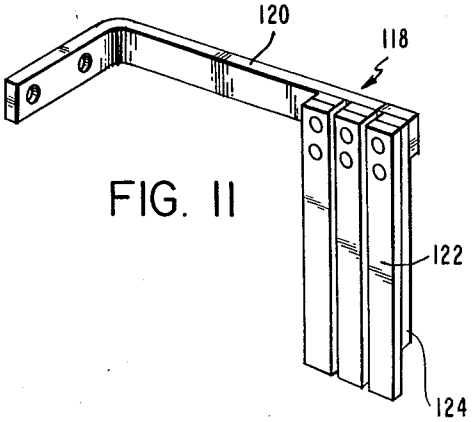
FIG. 11 is an isometric view of the commutation fingers.

The rollers 100 in the tank 18 communicate with the bus bar 104 through contact member 118. The detail of the contact member 118 seen in FIG. 11 shows that the contact members 118 are formed of a coppèr bar 120 and a plural array of phosphor bronze fingers 122 and 124 that together provide the positive contact over a sufficiently large area on the contact roller 100 to avoid creating a high resistance condition at the point of contact. The fingers 122 and 124 are resiliently mounted on the bar 120 and by the nature of the material, are urged into contact with the contact roller 100 at all times.

Thus, a high strength positive electrical contact assembly is provided for an environment wherein conventional brush contacts cannot serve well.

The high voltage-high current process of the present invention is further facilitated by means for protecting the fibers 2 during the passage between the electrolyte bath and the various contact rollers. The system includes the recirculating spray system 126 shown generally in FIGS. 8 and 9 through which electrolyte is recycled from the plating tanks and sprayed through the spray nozzles 130 on the fibers 2 at contact points on the contact rollers 100.

Figure 15:
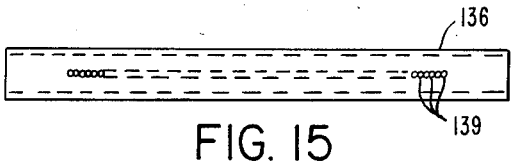
FIG. 15 is a detail plan view of the nozzles of the spray assembly of FIG. 12.

The spray nozzles 130 are arranged with two parallel tubular arms 136 and 138 having nozzle openings 139 located on the lower surfaces thereof. As best seen in FIG. 15, one tubular arm 136 of the spray nozzle 130, is arranged to direct electrolyte tangentially on the fibers 2 at the point at which the fibers 2 leave the contact roller 100. The other tubular arm 138 of the spray nozzle 130 is arranged to deliver electrolyte directly on the top of the contact roller 100 at the point at which the fiber 2 engages the contact roller 100. As previously indicated, it is vital that sufficient tension be applied on the fibers 2 to insure that the fibers 2 are maintained in a tight direct line between the contact rollers 100 and the idler rollers 112. The need for a tight line is to assure that the low contact resistance suitable for current travel is available with high conductivity through the fibers 2 from the contact rollers 100 to the electrolyte bath. The electrolyte which is recirculated over the contact rollers 100 and the fibers 2 provide a parallel resistor in the circuit and serve to cool the fibers 2.

It is known that the fibers 2 being plated have a low fusing current, such as 10 amps for a 12K tow of about 7 microns in diameter. However, the process of the present invention requires about 25 amps between contacts or about 125 amps per strand in each tank.

Furthermore, both contact resistance and anisotropic resistance must be overcome. The contract resistance of 12K tow of about 7 microns on pure clean copper is about 2 ohms, thus at 45 volts twenty-two and one-half amps are required before any plating can occur. The anisotrophic resistance is 1,000 times the long axis. Thus, the total contact area must be 1,000 times the tow diameter, which for 7 microns is 0.34 inches. Practice has taught that one-half inch of contact will properly serve the electrical requirement of the system when plating 7 micron tow, hence two and three inch contact rollers 100 are used. It is also vital that the contact rollers 100 be located at a specified distance above the electrolyte bath to enable the system to operate at the high voltages necessary to achieve the plating of the process. In practice, it has been found that the contact rollers 100 should be located one-half to one inch from the electrolyte bath when voltages of 16 to 25 volts are applied. Further, it has been found that recirculation of about 2 galons per minute per contact roller traveling at about $1\frac{1}{2}$ to 25 ft./min. will properly cool the fiber and provide a suitable parallel resistor when above 5,000 amps are passed through the system on three cells.

The electrolyte in the process is a solution constituted of eight to ten ounces of metal, preferably in the form of $NiCl_2$ and $NiSO_4$ per gallon of solution. The pH of the solution is set at 4 to 4.5 and the temperature maintained between 145° and 150° F. Recirculation of the electrolyte through the spray nozzles 130 at the desired rate requires that the nozzle openings be 3/32 inches in diameter on $\frac{1}{8}''$ centers over the length of each tubular arm 136 and 138. The presence of electrolyte on the fibers is vital, but care is taken to avoid excessive electrolyte otherwise the contact rollers will become subjected to the plating occurring in the electrolyte.

Figure 20:
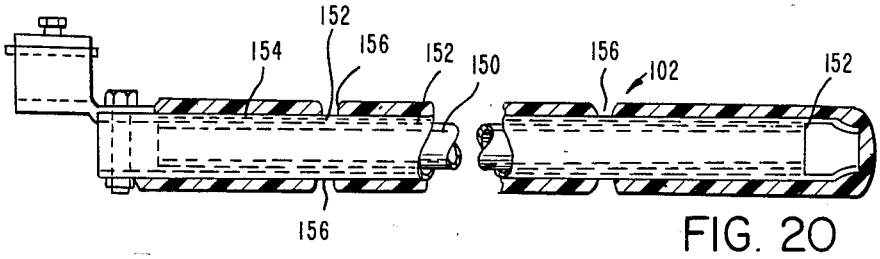
FIG. 20 is a partially exploded sectional elevational view of the contact mount for the anode basket.

The anode support bar 102 for the anode basket 110 is shown in detail in FIG. 20 and is comprised of essentially three layers. A steel inner bar 150 is provided to afford structural support for the anode basket 110. A copper coating 152, such as a copper pipe, over the steel bar 150 is provided to afford the electrical properties desirable for the passage of current, and an insulator of some material, such as vinyl 154, is provided to insulate the entire anode support bar 102. At strategic locations on the bar 102, the vinyl is removed and notches 156 expose the copper coating 152 to afford electrical contact.

Figure 21:
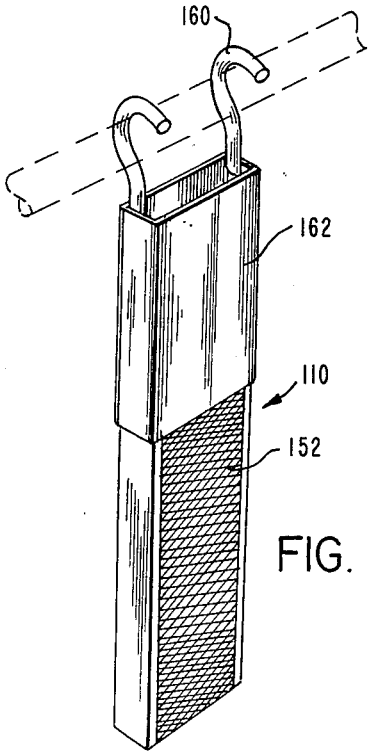
FIG. 21 is an isometric view of the anode basket of the subject invention.
Figure 16:
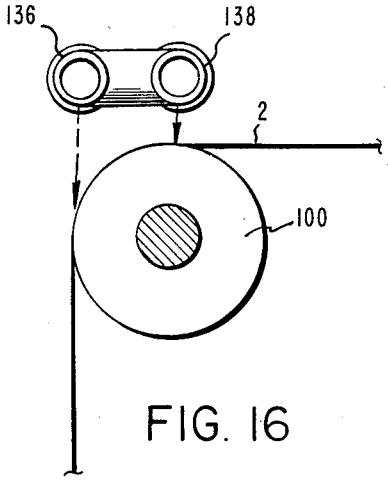
FIG. 16 is a schematic of the electrolytic coolant conductor and a contact roller.

As best seen in FIG. 21, the anode basket 110 is provided with the conventional openings 158 found in anode baskets but also has a vinyl insulated covering 162 that extends from the top of the anode basket 110 to a location below the surface of the electrolytic bath. Practice has taught that insulating the anode basket 110 four to twelve inches from the top will protect the anode basket 110 from destruction of the protective oxide under the high intensity current and voltage conditions experienced in the process. The conventional hooks 160 found on the anode baskets 110 are arranged to fit within the notches 156 provided on the anode support bar 102. Further, the anode basket is preferably made of titanium due to the nature of the high voltage environment and the electrolyte. The high voltage has been found to remove the surface of the titanium which is normally a $TiO_2$ layer that protects the anode basket 110 from the electrolyte.

Figure 19:
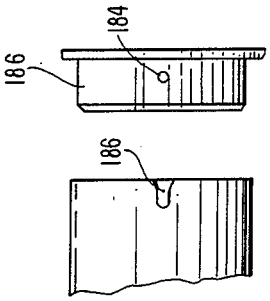
FIG. 19 is a partial detail of the opposite end of the roller of FIG. 17.
Figure 18:
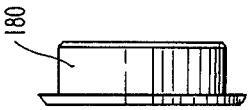
FIG. 18 is a detail of the end cap of the roller of FIG. 17.
Figure 17:
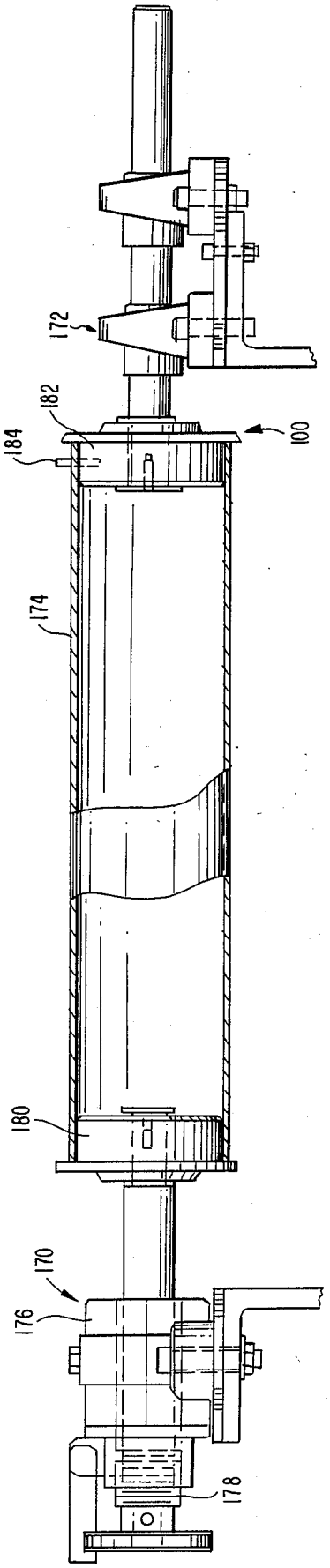
FIG. 17 is a sectional elevational view of a contact roller of the process assembly.

The contact rollers 100 are shown in detail in FIGS. 17–19. Each contact roller 100 is located in close proximity to the electrolyte in the plating tanks and each is adapted to transmit high current through the system in a high intensity voltage environment. The contact roller 100 thus is designed for continual replacement. The contact roller 100 is provided with fixed end mounting sections 170 and 172 which hold a cylindrical copper tube 174. The cylindrical copper tube 174 is arranged to contact the commutator fingers 122–124 and deliver current through both the fibers 2 and recycled electrolyte to the electrolyte bath. The copper tube 174 is formed of conventional type L copper which must be able to carry 350 amperes. The diameter of the tubing is critical in that the diameter dictates the contact surface for the fibers 2 and the distance that the contact roller 100 will be from the electrolyte surface. As a result, the mounts 170 and 172 are fixedly arranged in alignment with each other to releasably support the tube 174 of the contact roller 100. The mount 170 is provided with a bearing support 176 through which a screw mount 178 passes. The screw mount 178 rotatably supports the copper tube 174 on a bushing support 180 and has the capacity to release the copper tube 174 upon retraction of the bushing support 180 by withdrawing the screw 178. The mount 172 includes a bushing support 182 on which a detent 184 is formed. Each copper tube 174 is provided with a notched mating slot 186 to fit around the detent 184 and effect positive attachment of the copper tube 174 to the bushing support 182 thereby obviating any uncertainty in alignment and facilitating dispatch in replacing each copper tube section 174.

The overall electrical system 188 of the process and apparatus is shown schematically in FIG. 22 wherein the capacity for discrete application of voltage and current to each electrolytic tank 18, 20, 22, 24 can be seen. Conventional rectifiers 189, 191, 193 and 195 are arranged as a D.C. power source to deliver current to the respective contact rollers 100 on each electrolytic tank. Bus bars 104, 194, 196, 198 are shown for illustration extending respectively from the rectifiers 189, 191, 193 and 195 to one of the six contact rollers 100 on the electrolytic tanks 18, 20, 22 and 24. However, all six contact rollers 100 on each electrolytic tank are directly connected to the same bus bar. Bus bars 106, 202, 204 and 206 are shown extending respectively from the same rectifiers 189, 191, 193 and 195 through cables 208 to one anode support bar 102 mounted on the electrolytic tanks 18, 20, 22 and 24. Again the respective anode bus bars contact each anode support bar 102 mounted on each electrolytic tank connected to the bus bar.

As a result of the arrangement, discrete high voltage can be delivered to each electrolytic tank 18, 20, 22, 24 as a function of the metal plating on the fibers 2 in each electrolytic tank.

Practice has taught that in volume production the voltage in the first electrolyte tank 18 should not be below 16 volts and seldom be below 24 volts. The voltage in the second tank 20 should not be below 14 volts and the voltage in the third electrolyte tank 22 should not be below 12 volts.

Illustratively, fibers 2 have been coated in a system of three rectifier-electrolyte tank assemblies, rather than the four shown in FIGS. 1 and 22, under the following conditions wherein excellent coating has resulted:

| | | | |
|---|---|---|---|
| RECTIFIER | 189 | 191 | 193 |
| AMPS | 1,400 | 1,400 | 1,400 |
| VOLTS | 45 | 26 | 17 |

The nickel metal coated fibers 2 produced under these conditions have the following properties and characteristics:

| | |
|---|---|
| Filament Shape | Round (but dependent on graphite fiber) |
| Diameter | 8 microns |
| Metal Coating | Approximately 0.5 microns thick, about 50% of the total fiber weight. |
| Density | 2.50–3.00 grams/cm.$^3$ |
| Tensile Strength | Up to 450,000 psi |
| Tensile Modulus | 34 M psi |
| Electrical Conductivity | 0.008 ohms/cm. (12K tow) 0.10 ohms/1000 strands/cm. |

After the nickel plating has occurred, the fully plated fibers 2 are delivered to the rinsing section 12 seen in FIG. 1.

The drag-out section 42 and rinse section 46 are arranged with tanks to accumulate the discharge from the tees 44, 44A, 44B, 48 and 48A and both neutralize the discharge for waste disposal and provide a repository for accumulation of make-up for the electrolyte tanks 18, 20, 22 and 24.

Figure 23:
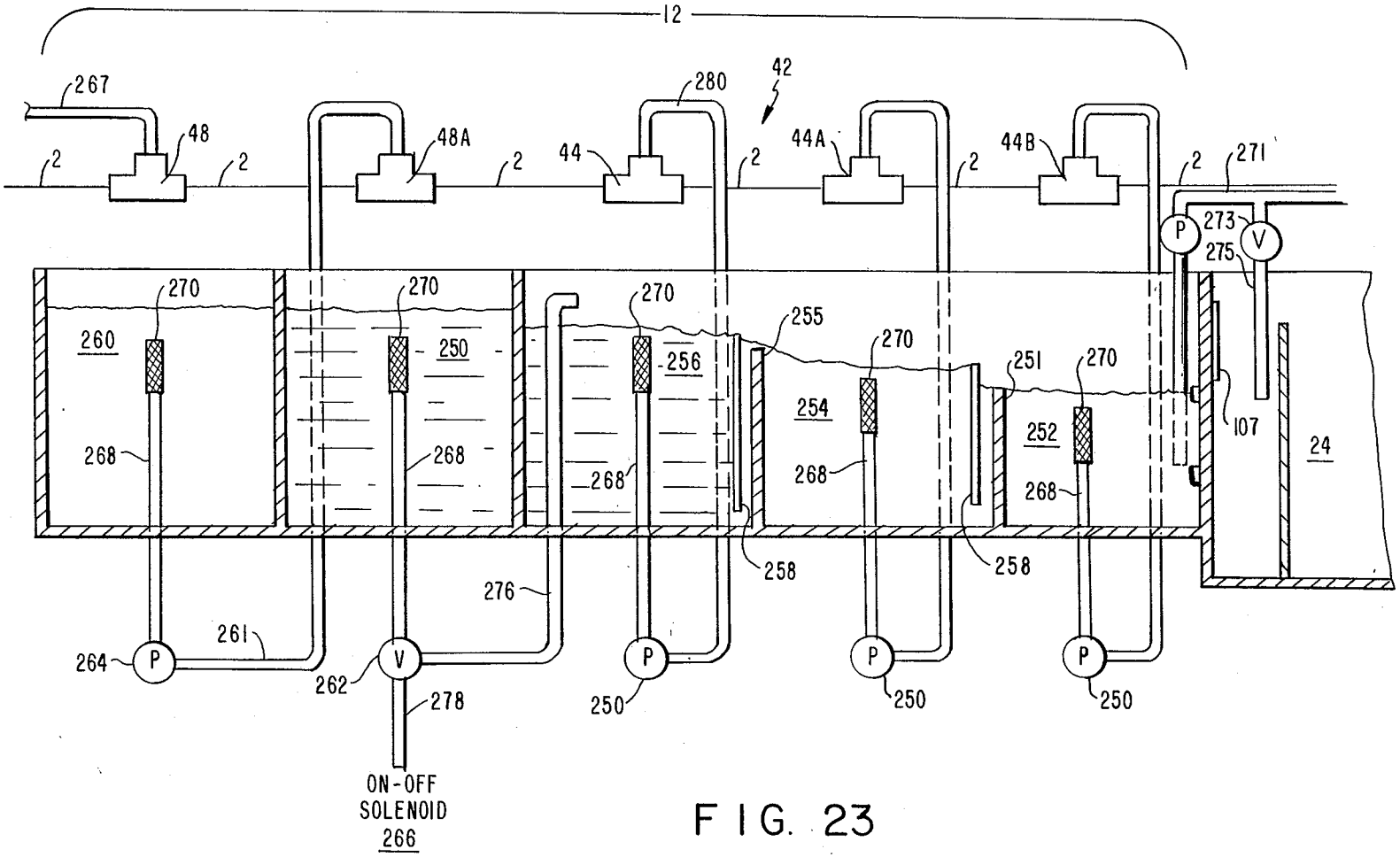
FIG. 23 is a sectional elevational view of the rinse tanks and associated apparatus.

As best seen in FIG. 23, the tanks in the drag-out section 42 consist of a cascading tank with separate compartments 252, 254 and 256. The cascading tank is a conventional three station cascade counter-current rinse tank manufactured by National Plastics, Thermal Electron Division. The cascading tank automatically provides for passage of the discharge fluid from the downstream tanks to the upstream tank by passage around the overflow dams 258. The fluid accumulated in tank 256 will reach a level above the separation wall 255 between tank 256 and tank 254 and pass to tank 254. Similarly, when the level in tank 254 is greater than the level of the separation wall 251, the fluid will pass further upstream to tank 252.

The rinse section includes tanks 250 and 260. Both tanks 250 and 260 are provided with stand pipes 268 having basket filters 270 arranged at the top opening. A conveying line 261 is connected to the stand pipe 268 in tank 260 and is provided with the pump 264. The discharge from tank 260 is pumped to the tee 48A associated with tank 250 to rinse the fibers 2. The discharge from the tank 250 is delivered through line 276 to the cascading tank assembly, or alternatively through line 278 to waste disposal.

A line 271 is provided to connect the discharge in the tank 252 to the tanks 18, 20, 22 and 24 which are equipped with level control devices 107 that open solenoid valve 273 when the level in a tank 18, 20, 22 or 24 drops to a level that requires electrolyte.

In the operation, the fibers 2 pass through the tees 44B, 44A, 44, 48A and 48 and are rinsed with water. The clear water is delivered to the system through line 267 to the tee 48 and flows counter to the direction of the fibers 2 to discharge through the upstream end of the tee 48 into the tank 260. The discharge from the tank 260 is pumped to the fluid inlet of tee 48A and is discharged through the upstream end of the tee 48A into the tank 250. The fluid in the tank 250 is relatively dilute due to the previous rinse treatment of the fibers 2, thus it can be discharged through line 278 as waste or delivered to the tank 256 as needed. The tanks 256, 254 and 252 operate continuously in the recirculation mode, thereby producing a fluid that becomes increasingly rich in electrolyte. As a result, a minimum of contaminated water is generated in the system while an electrolyte rich solution is produced for electrolyte make-up.

Figure 24:
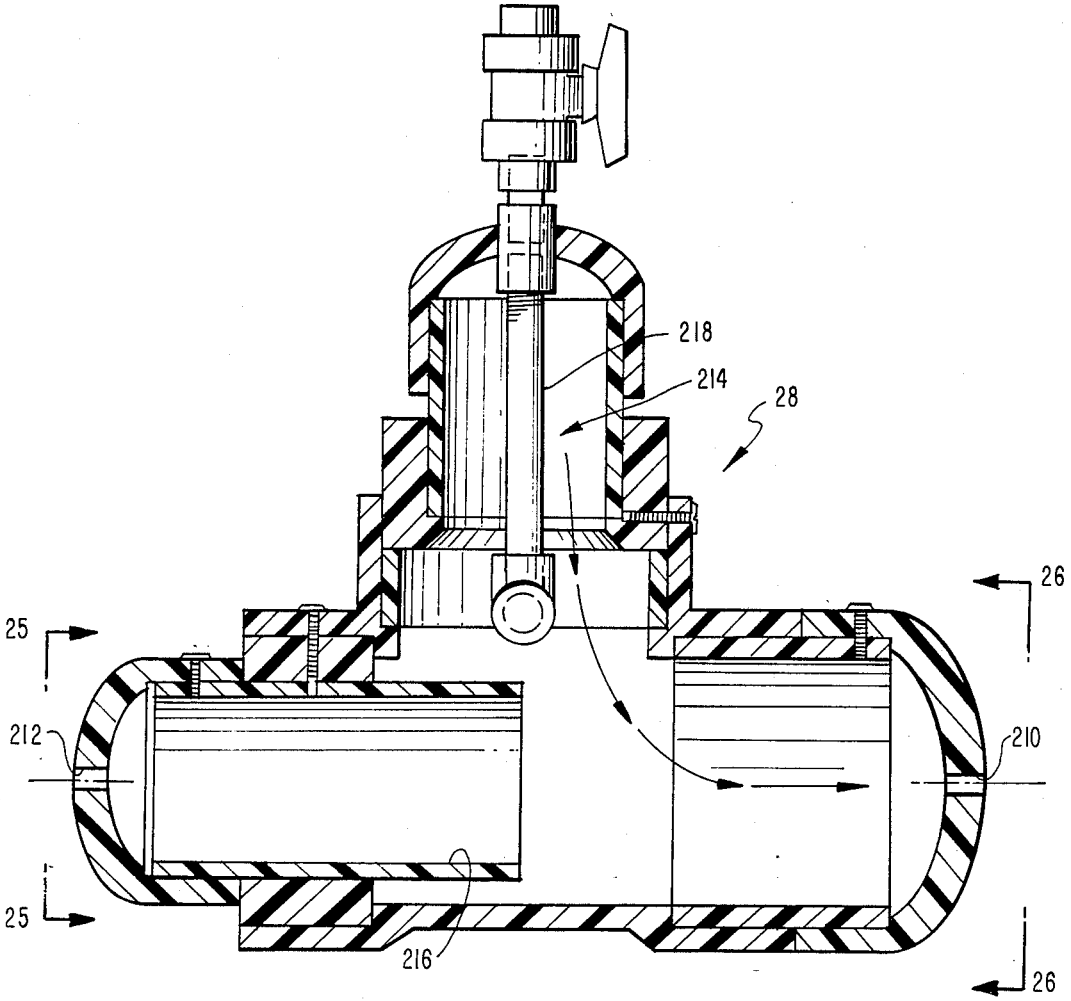
FIG. 24 is a sectional elevational view of the washing-tee of the subject invention.
Figure 25:
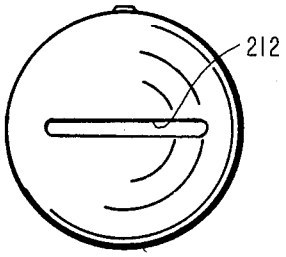
FIG. 25 is a view through line 25—25 of the washing-tee of FIG. 24.
Figure 26:
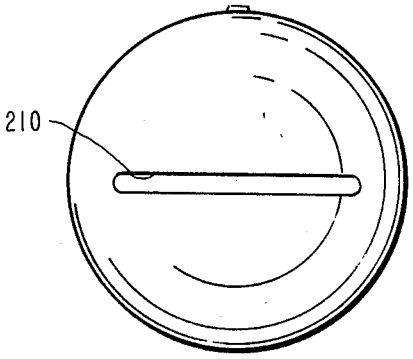
FIG. 26 is a view through line 26—26 of the washing-tee of FIG. 24.

A tee, designated 28, used in the system pre-treatment section 8 and rinse section 12 is shown in FIGS. 24–26. As previously indicated, the tees are designed to afford countercurrent travel of solution with the fibers 2. In practice, the tees 28 are designed with an upstream opening 210 and a downstream opening 212 for the passage of fibers 2 therethrough. The tees 28 are also provided with a dome housing 214 through which the solution such as rinse water can enter and bathe the fibers 2 as the fibers 2 pass through the tee 28. The tees 28 are also provided with a sleeve 216 that creates a pressure head which directs water in the upstream direction. In addition, the tees are designed with the opening 210 for the passage of fibers 2, at an elevation slightly below the opening 212. Thus, the path by which water escapes from the tee is from the delivery pipe 218 through the opening 210. The combination of the differential elevation in the openings 210 and 212 and the presence of the sleeve 216 located in the downstream section of the tee 28 promotes travel of the solution in a direction upstream as the fibers are moving downstream.

Figure 27:
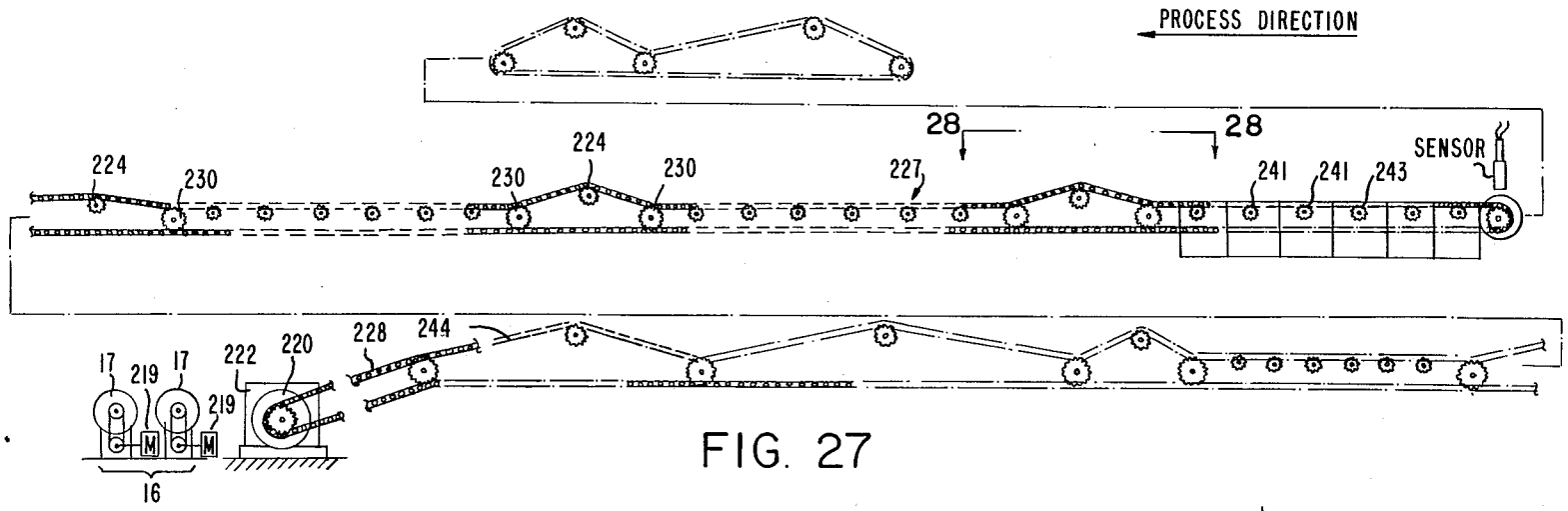
FIG. 27 is a drawing of the mechanism for synchronously driving the apparatus of the subject invention.
Figure 28:
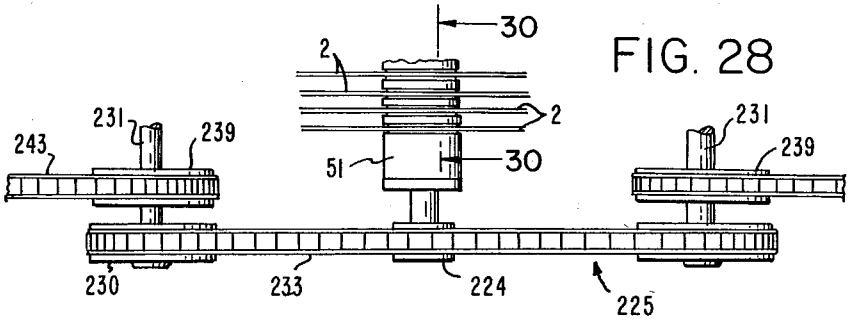
FIG. 28 is a plan view through line 28—28 of the section of FIG. 27.
Figure 29:
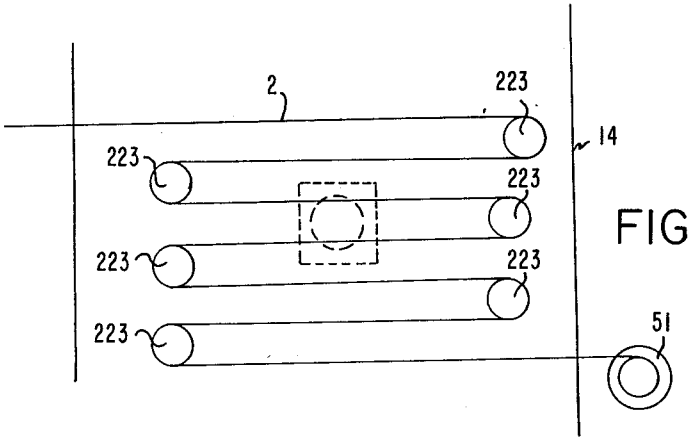
FIG. 29 is a side elevational view of the roller assembly in the drying section of the system.

The apparatus of the present invention is arranged for synchronous operation as shown in FIGS. 27–29. A motor 222 is provided to insure that the contact rollers 100 and the guide rollers 51 rotate at the same speed to avoid abrading the fibers 2.

The motor 222 directly drives an assembly of rollers 223 arranged to effect a capstan. The rollers 223 are located in the dryer 14 and as best seen in FIG. 29 cause the fiber to reverse direction six times. The reversal in direction is sufficient to impose a force on the fibers 2 that will pull the fibers through the apparatus without allowing slack.

In addition, the motor 222 is connected by a gear and chain assembly to drive each contact roller 100 and each guide roller 51 at the same speed.

In essence, the gear and chain assembly is comprised of guide drive assemblies 225, best seen in FIG. 28 and contact roller drive assemblies 227. Each guide drive assembly 225 includes drive transmission gear 230 mounted on shafts 231, a gear 224 fixedly secured to the guide roller 51 and a chain 233 that engages the gears 230 and 224.

The contact roller drive assembly includes drive transmission gear 239 mounted on the shafts 231 common to the gears 230, a gear 241 fixedly secured to each contact roller 100 and a chain 243 that engages both gears 239 and each of the gears 241 on the six contact rollers 100 associated with each electrolyte tank.

Figure 30:
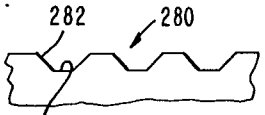
FIG. 30 is a sectional view of a guide roller shown through line 30—30 of FIG. 29.

As seen in FIG. 30 each guide roller 51 is formed with grooves 280 having tapered sides 282 and flat surfaces 284. The diameter of the guide roller at the surface 284 is the same as the diameter of the contact rollers 100 and the capstan rollers 223, thus constant speed is experienced by the fibers 2 along the path through the apparatus.

The flat surfaces 284 afford a means by which the fibers or tows 2 spread to either facilitate drying or wetting depending on the operative effect desired.

The location of the capstan rollers 223 in the dryer 14 enhances drying. The flat surface and force applied to the fibers 2 spreads the fibers and thereby accelerates drying.

The system also includes a variable speed clutch override drive motor 219 for the take-up reels 17. The force generated by the variable torque motor 219 provides the force to draw the fiber 2 through the system. However, the capstan rollers 223 provide a means to isolate the direct force imposed on the fibers 2 at the take-up reels 17 from the fibers 2 upstream of the capstan rollers.

What is claimed is:

1. A process for electroplating graphite fiber comprising:
   (a) passing the fiber continuously through an electrolyte solution in a tank in which a metal anode is immersed;
   (b) passing D.C. current through the fiber to the anode by delivering said current to the fiber at a contact immediately prior to the surface of the electrolyte in the tank;
   (c) maintaining the voltage across the electrolyte from the fiber to the anode above 16 volts; and
   (d) maintaining the fiber cool enough outside the bath to prevent degradation by recycling the electrolyte to bathe the fiber from the point of contact to the point of immersion into the electrolyte bath whereby metal from the anode migrates to the fiber and is bonded thereto.

2. A process as in claim 1, further comprising the steps of:
   (a′) passing the metal-coated fiber continuously through a second electrolyte solution in a second tank in which a metal anode is immersed;
   (b′) passing D.C. current through the metal-coated fiber to the anode in the second tank by delivering said current to the fiber at a contact immediately prior to the surface of the electrolyte in the tank;
   (c′) adjusting the voltage across the electrolyte from the fiber to the anode to a quantity above 14 volts as a function of the resistance developed by the metal-coated fiber in the second tank; and
   (d′) maintaining the fiber cool enough outside the bath to prevent degradation by recycling the electrolyte to bathe the fiber from the point of contact to the point of immersion into the electrolyte bath whereby metal from the anode migrates to the fiber and is bonded thereto.

3. A process as in claim 2, further comprising the steps of:
   (a″) passing the metal-coated fiber continuously from the second tank of electrolyte through a third electrolyte solution in a third tank in which a metal anode is immersed;
   (b″) passing D.C. current through the metal-coated fiber to the anode in the third tank by delivering said current to the fiber at a contact immediately prior to the surface of the electrolyte in the tank;
   (c″) adjusting the voltage across the third electrolyte from the fiber to the anode to a quantity above 12 volts as a function of the resistance developed by the metal-coated fiber in the third tank; and (d") maintaining the fiber cool enough outside the bath to prevent degradation by recycling the electrolyte to bathe the fiber from the point of contact to the point of immersion into the electrolyte bath whereby metal from the anode migrates to the fiber and is bonded thereto.

4. A process as in claim 3, wherein the voltage in the first tank is about 45 volts and the current is about 1,400 amps; the voltage in the second tank is about 26 volts and the current is about 1,400 amps; and the voltage in the third tank is about 17 volts and the current is about 1,400 amps.

5. A process as in claim 1, wherein the voltage is above 24 volts.

6. A process as in claim 1, further comprising the steps of:

(a) passing the metal-coated fiber continuously through electrolyte solutions in successive tanks arranged in series in which metal anodes are immersed;

(b) passing D.C. current through the metal-coated fiber to the anode by delivering said current to the fiber at a contact immediately prior to the surface of the electrolyte in the tank;

(c) adjusting the voltage in each of the tanks across the electrolyte from the fiber to the anode to a quantity above 12 volts as a function of the resistance developed by the metal-coated fiber passing through each tank; and (d) maintaining the fiber cool enough outside the bath to prevent degradation by recycling the electrolyte to bathe the fiber from the point of contact to the point of immersion into the electrolyte bath whereby metal from the anode migrates to the fiber and is bonded thereto.

7. A process as in claim 6, further comprising the step of rinsing the metal-coated fiber after the metal coating process has been completed.

8. A process as in claim 7, wherein the metal-coated fiber is rinsed with water in a flow counter-current with the flow of the fiber.

9. A process as in claim 8, further comprising the step of steam treating the rinsed metal-coated fiber.

10. A process as in claim 9, further comprising the step of drying the steam treated metal-coated fiber.

11. A process as in claim 10, further comprising the step of reeling the metal-coated fiber on capstans.

12. A process as in claim 11, wherein the capstan provides the motive force to pass the fiber through the system.

13. A process as in claim 1, further comprising the step of pre-treating the fiber to clean the fiber prior to delivery to the electrolyte.

14. A process as in claim 13, wherein pre-treatment cleaning of the fibers is comprised of the steps of:

(a) passing the fibers counter-currently with a solution of tri-sodium phosphate;

(b) passing the fibers leaving the tri-sodium phosphate wash through a rinse.

15. A process as in claim 14, wherein the pretreatment further comprises the step of passing the fibers counter-currently through a hydrochloric acid wash; and rinsing the fibers with water after the hydrochloric acid wash.

16. A process as in claim 15, wherein the hydrochloric acid solution is a 10% hydrochloric acid solution.

17. A process as in claim 14, wherein the tri-sodium phosphate solution is a mixture of 8 ounces of tri-sodium phosphate per gallon of water at 180° F.

18. A process as in claim 1, wherein a plurality of fibers are passed through the system in parallel arrangement and simultaneously coated with metal.

19. A process as in claim 1, wherein the contact is a contact roller and further comprising the step of rotating the contact roller in the direction of the fiber.

20. A process as in claim 1, further comprising the step of bathing the fiber with recycled electrolyte discharged at both the point of initial engagement with the contact and at the point of departure from the contact.

21. A process as in claim 1, further comprising the step of rinsing the metal-coated fiber after the metal coating has been completed.

* * * * *